US010399100B2

(12) United States Patent
Aoyama et al.

(10) Patent No.: US 10,399,100 B2
(45) Date of Patent: Sep. 3, 2019

(54) FOAM DISPENSER

(71) Applicant: Kao Corporation, Tokyo (JP)

(72) Inventors: Ryohei Aoyama, Soka (JP); Yoshinori Inagawa, Chiba (JP); Noboru Yashima, Bunkyo-ku (JP)

(73) Assignee: Kao Corporation, Tokyo (JP)

( * ) Notice: Subject to any disclaimer, the term of this patent is extended or adjusted under 35 U.S.C. 154(b) by 36 days.

(21) Appl. No.: 15/539,219

(22) PCT Filed: Dec. 24, 2015

(86) PCT No.: PCT/JP2015/085995
§ 371 (c)(1),
(2) Date: Jun. 23, 2017

(87) PCT Pub. No.: WO2016/104591
PCT Pub. Date: Jun. 30, 2016

(65) Prior Publication Data

US 2018/0326434 A1 Nov. 15, 2018

(30) Foreign Application Priority Data

Dec. 24, 2014 (JP) ..... 2014-259947

(51) Int. Cl.
*B05B 7/00* (2006.01)
*B05B 11/00* (2006.01)
*B05B 15/50* (2018.01)

(52) U.S. Cl.
CPC ..... *B05B 7/0037* (2013.01); *B05B 11/306* (2013.01); *B05B 11/3069* (2013.01); *B05B 11/3087* (2013.01); *B05B 15/50* (2018.02)

(58) Field of Classification Search
CPC ..... B05B 7/0037; B05B 15/50; B05B 11/306; B05B 11/3069; B05B 11/3087
(Continued)

(56) References Cited

U.S. PATENT DOCUMENTS 4,044,923 A * 8/1977 Gardner ..... B05B 7/0037 222/190
5,156,307 A 10/1992 Callahan et al.
(Continued)

FOREIGN PATENT DOCUMENTS

CN 1090796 A 8/1994
DE 28 23 253 A1 5/1979
(Continued)

OTHER PUBLICATIONS

Extended European Search Report dated Jul. 16, 2018 in European Patent Application No. 15873159.6, 11 pages.
(Continued)

*Primary Examiner* — Lien M Ngo
(74) *Attorney, Agent, or Firm* — Oblon, McClelland, Maier & Neustadt, L.L.P.

(57) ABSTRACT

The present invention provides a foam dispensing unit (10) that dispenses a content liquid in a foamed state by causing the content liquid pumped out via a liquid flow channel (23) to pass through a porous member (29) provided in a foaming flow channel (24) together with air, the foam dispensing unit including a mechanism for variably positioning a passage surface (40), the mechanism rotatably holding the porous member (29) in the foaming flow channel (24) to variably position a content liquid passage surface of the porous member (29). The mechanism for variably positioning a passage surface (40) includes a loosely holding region (41) formed in the foaming flow channel (24) and the porous member (29) loosely mounted in the loosely holding region (41). The porous member (29) has a spherical shape, and freely rotates inside the loosely holding region (41) due to an action of a stream of the content liquid passing through the loosely holding region (41), so as to replace a surface thereof in a pass-through direction.

13 Claims, 11 Drawing Sheets

(58) Field of Classification Search
USPC ..... 222/190, 153.13, 321.1, 321.7
See application file for complete search history.

(56) References Cited

U.S. PATENT DOCUMENTS

| | | | | |
|---|---|---|---|---|
| 5,611,490 | A | 3/1997 | Barriac et al. | |
| 7,234,885 | B2 * | 6/2007 | Gueret | A45D 19/02 222/190 |
| 8,820,585 | B1 * | 9/2014 | Banks | B05B 7/0037 222/1 |
| 9,868,128 | B2 * | 1/2018 | Tepas | B05B 7/0037 |
| 2014/0008394 | A1 | 1/2014 | Höfte | |

FOREIGN PATENT DOCUMENTS

| | | | | |
|---|---|---|---|---|
| DE | 695 15 618 | T2 | | 7/2000 |
| GB | 821793 | A | * | 10/1959 |
| GB | 1 389 515 | A | | 4/1975 |
| JP | 7-7759 | U | | 2/1995 |
| JP | 7-315463 | A | | 12/1995 |
| JP | 2011-51622 | A | | 3/2011 |
| JP | 2012-187463 | A | | 10/2012 |
| JP | 2017-171385 | A | | 9/2017 |

OTHER PUBLICATIONS

International Search Report dated Mar. 29, 2016 in PCT/JP2015/085995 filed Dec. 24, 2015.

* cited by examiner

[Fig. 1]
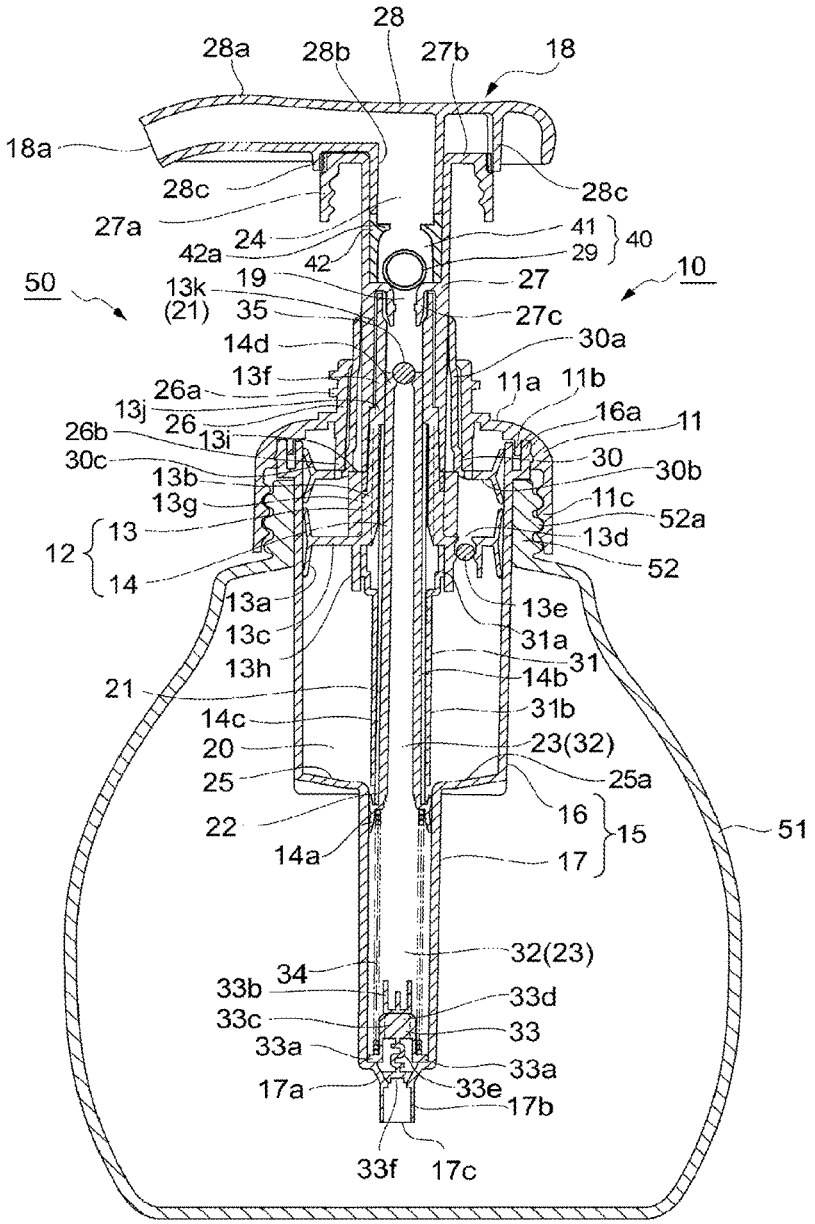

[Fig. 2]
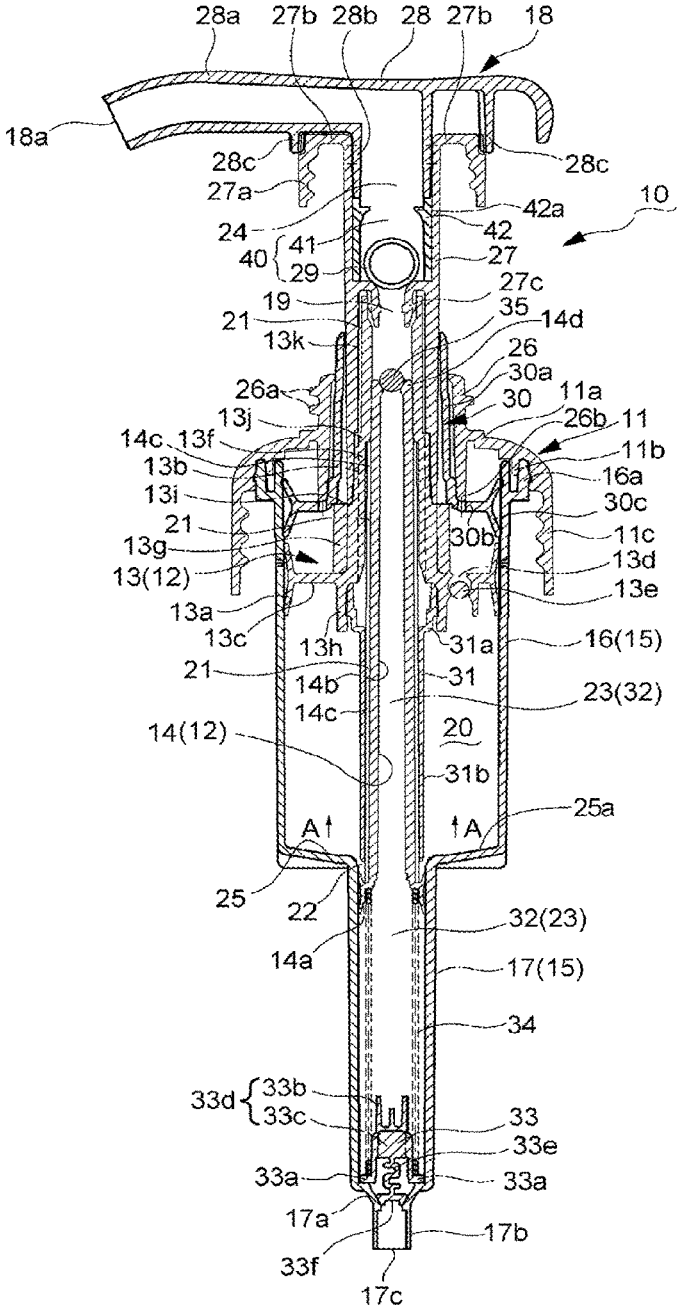

[Fig. 3]
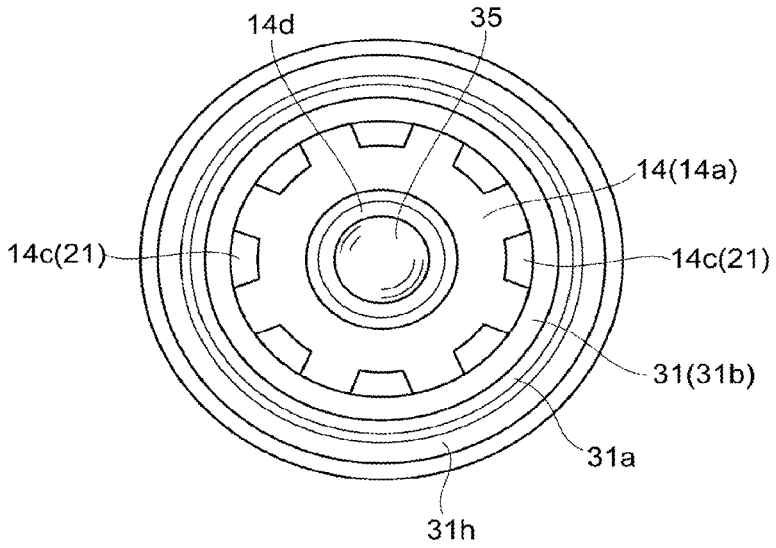
[Fig. 4(a)]
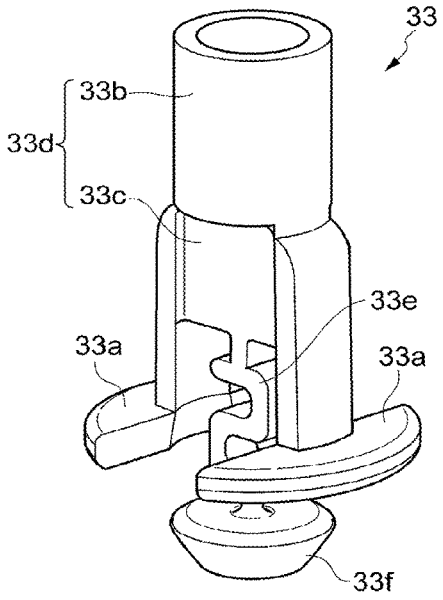

[Fig. 4(b)]
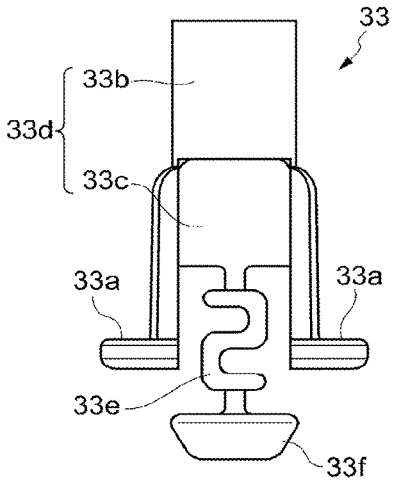
[Fig. 5]
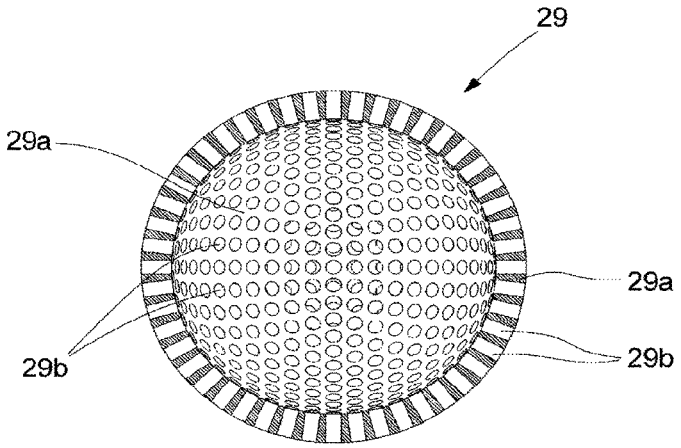

[Fig. 6]
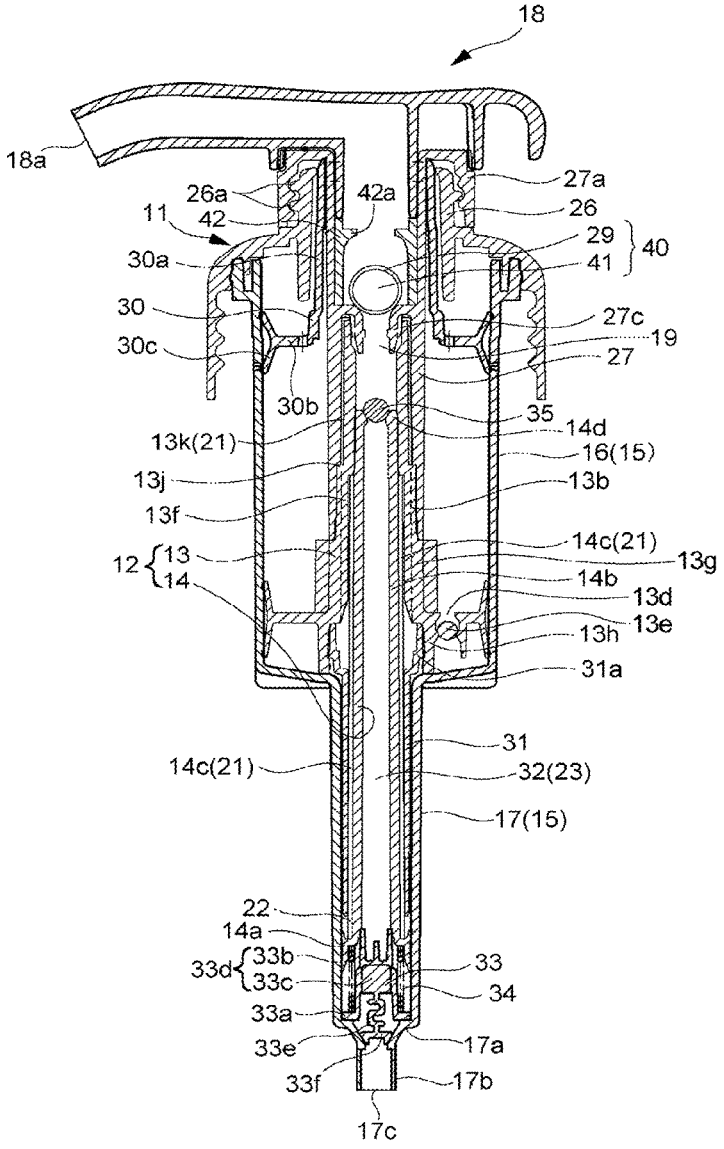

[Fig. 7]
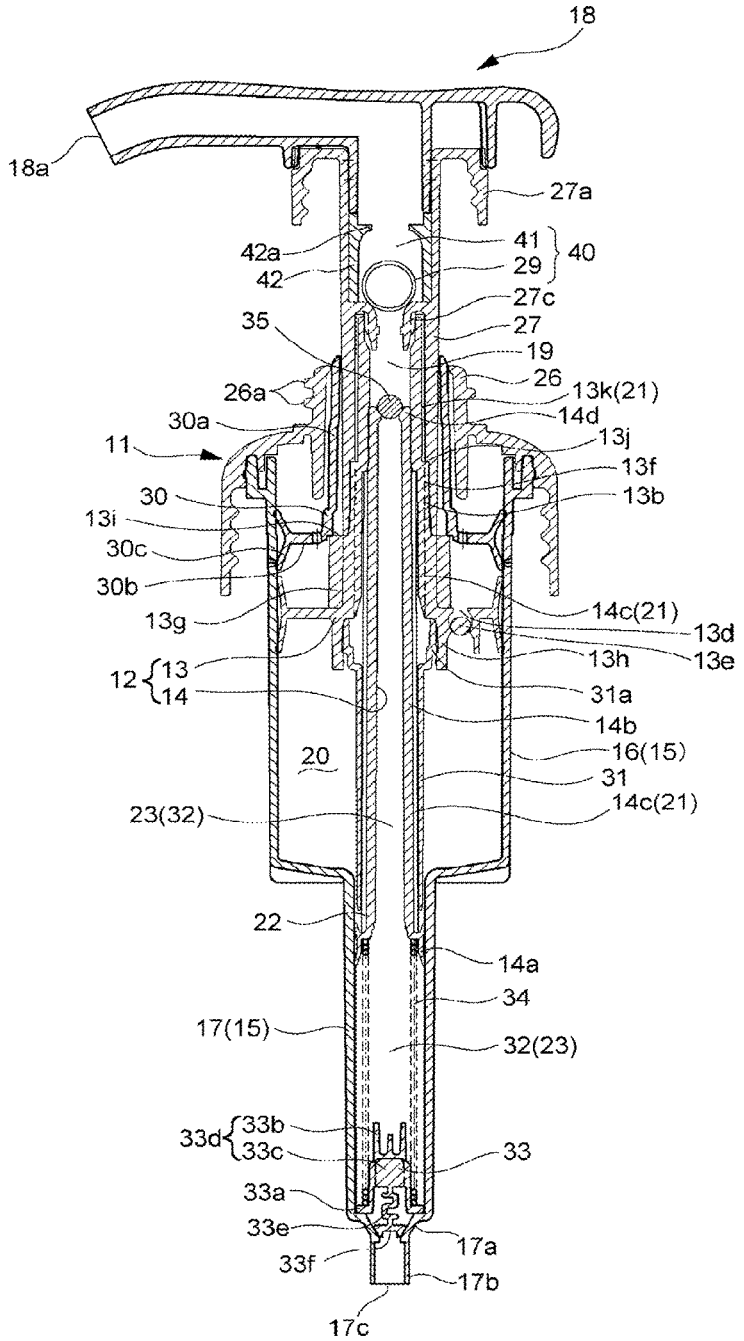

[Fig. 8(a)]
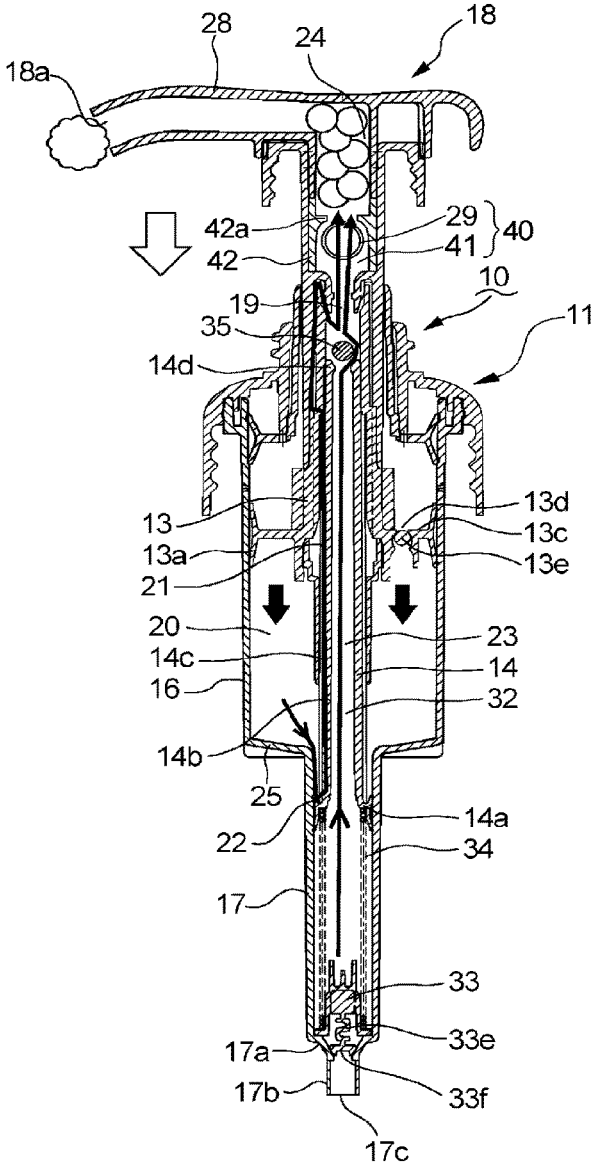

[Fig. 8(b)]
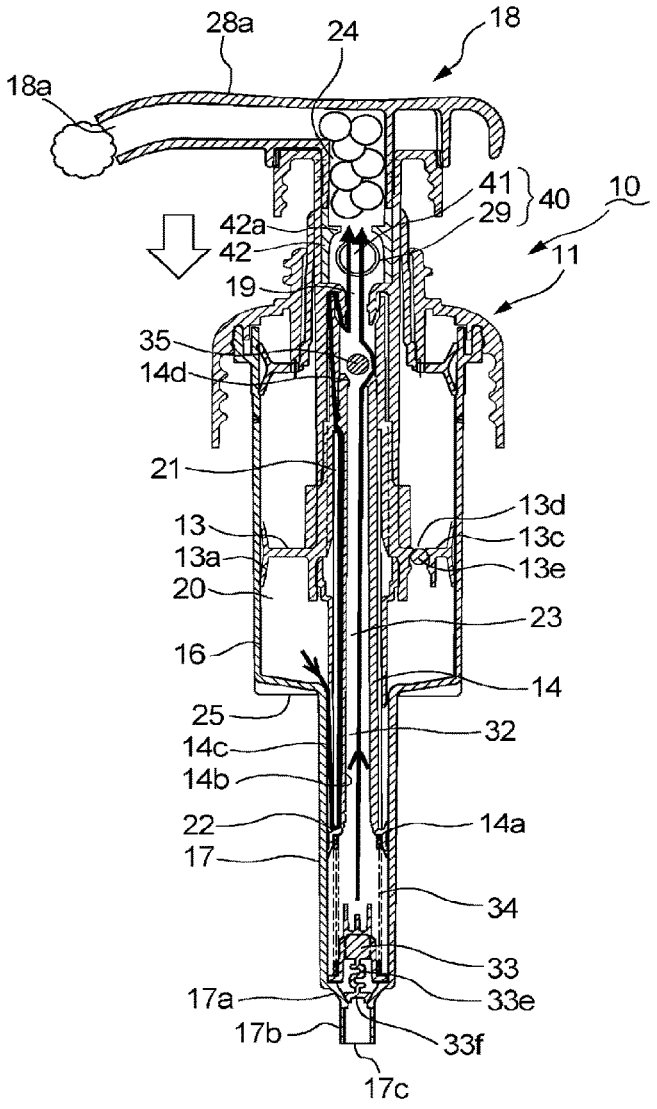

[Fig. 8(c)]
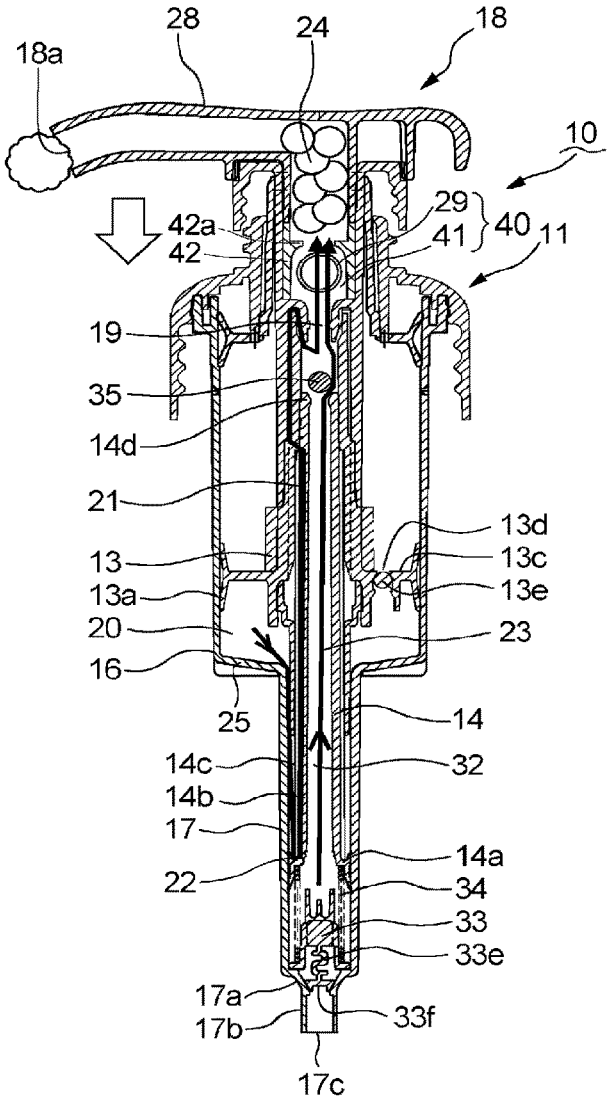
[Fig. 9(a)]
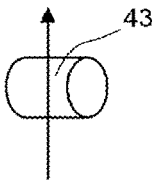

[Fig. 9(b)]
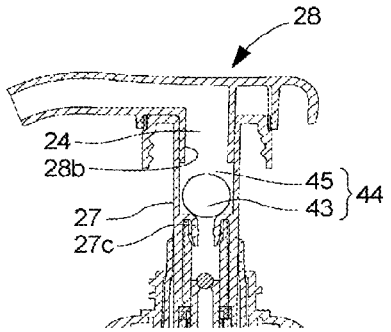
[Fig. 10(a)]
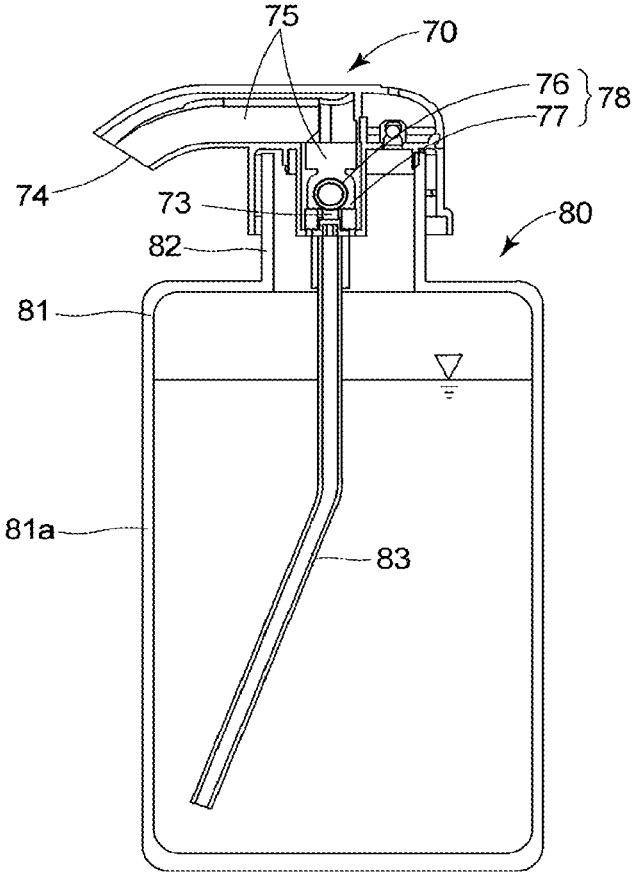

[Fig. 10(b)]
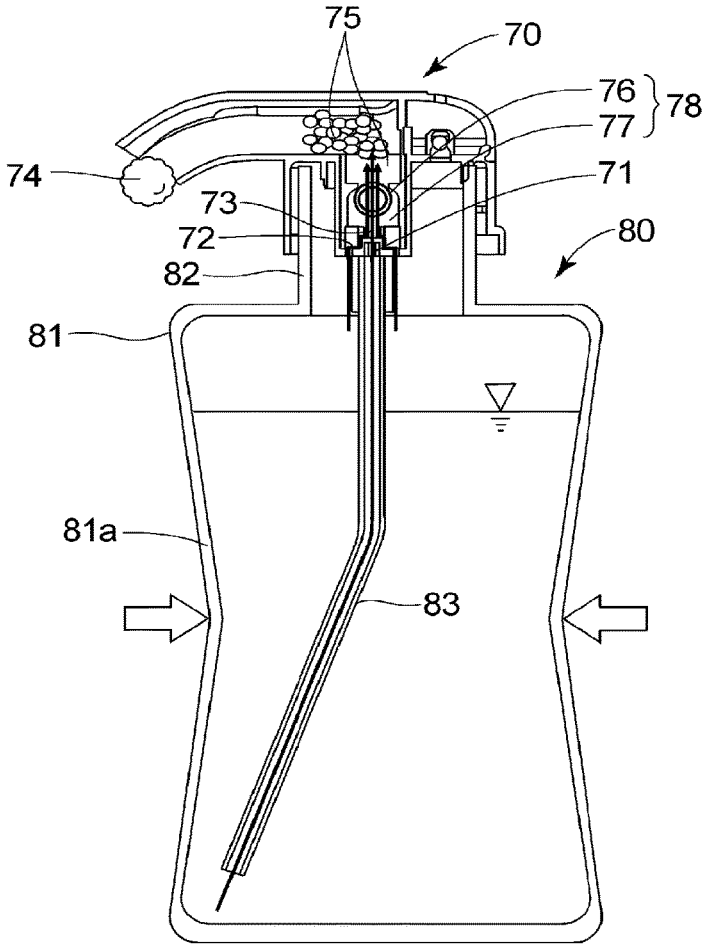
[Fig. 11(a)]
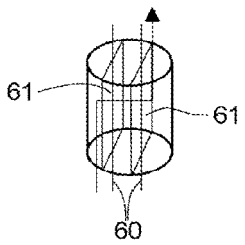
[Fig. 11(b)]
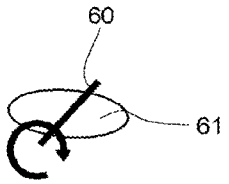

FOAM DISPENSER

CROSS REFERENCE TO RELATED APPLICATIONS

This application is a national stage entry under 35 USC 371 of PCT/JP2015/085995 filed on Dec. 24, 2015, and claims priority to Japanese Patent Application No. 2014-259947 filed on Dec. 24, 2014.

TECHNICAL FIELD

The present invention relates to a foam dispensing unit, and in particular to a foam dispensing unit that dispenses a content liquid in a foamed state by causing the content liquid pumped out via a liquid flow channel to pass through a porous member provided in a foaming flow channel together with air.

BACKGROUND ART

As a foam dispenser, which dispenses a content liquid contained in a dispenser body in a foamed state, there is known, for example, a pump foamer, which foams and dispenses the content liquid in response to a press of its pump head portion while the dispenser is kept stationary, without requiring user to, for example, manually stir the content liquid. In the pump foamer, a foam dispensing unit, which is configured to mix the content liquid with air to foam and dispense the content liquid, is mounted on a neck portion of a dispenser body. In the foam dispensing unit, a cap portion mounted on the neck portion of the dispenser body, for example, includes a pump mechanism including a cylinder portion in which a piston (liquid piston) for drawing, pressurizing and discharging a content liquid and another piston (air piston) for drawing, pressurizing and discharging air are concentrically arranged in series. In response to a push of the pump head portion protruding upward from the cap portion, the pistons of the pump mechanism are actuated to pressurize and discharge the content liquid and air inside the cylinder portion, and mix the content liquid and air in a confluence space, and the content liquid mixed with air is then allowed to pass through a porous member such as a mesh ring so as to foam the content liquid and dispense the foamed content liquid to the outside (see, for example, Patent Literature 1).

As another type of foam dispenser, for example, a squeeze foamer is known (see, for example, Patent Literature 2). The squeeze foamer is configured as follows: in response to a squeeze (press) of a flexible bottle-shaped dispenser body held in hand, the dispenser body deforms to decrease its volume decreases; and thereby a content liquid and air contained in the dispenser body are pumped out to a vertical dispensing flow channel of a nozzle cap including a dispensing nozzle portion constituting a foam dispensing unit, and allowed to pass through a porous member such as a mesh attached to the vertical dispensing flow channel so as to foam and dispense the content liquid through the dispensing nozzle portion.

CITATION LIST

Patent Literature

Patent Literature 1: JP H7-315463A
Patent Literature 2: JP 2011-51622A

SUMMARY OF INVENTION

The present invention relates to a foam dispensing unit that dispenses a content liquid in a foamed state by causing the content liquid pumped out via a liquid flow channel to pass through a porous member provided in a foaming flow channel together with air. The foam dispensing unit includes a mechanism for variably positioning a passage surface, the mechanism rotatably holding the porous member in the foaming flow channel to variably position a content liquid passage surface of the porous member.

BRIEF DESCRIPTION OF DRAWINGS

FIG. 1 is a cross-sectional view of a foam dispenser in which a foam dispensing unit according to a preferred embodiment of the present invention is attached to a neck portion of a dispenser body.

FIG. 2 is a cross-sectional view of the foam dispensing unit according to a preferred embodiment of the present invention when it is at top dead center prior to its pump head portion being pressed.

FIG. 3 is a cross-sectional view taken along the line A-A shown in FIG. 2.

FIG. 4(*a*) is a perspective view of an opening/closing valve provided at a lower end of a liquid cylinder.

FIG. 4(*b*) is a front view of the opening/closing valve provided at the lower end of the liquid cylinder.

FIG. 5 is an enlarged half cross-sectional view of a porous member.

FIG. 6 is a cross-sectional view of the foam dispensing unit according to a preferred embodiment of the present invention in a state when distributed and sold before use.

FIG. 7 is a cross-sectional view of the foam dispensing unit according to a preferred embodiment of the present invention in a state in which the pump head portion and the like are moving upward at the start of use.

FIG. 8(*a*) is a cross-sectional view illustrating a state in which a content liquid is foamed and dispensed in response to a press of the pump head portion.

FIG. 8(*b*) is a cross-sectional view illustrating a state in which the content liquid is foamed and dispensed in response to a press of the pump head portion.

FIG. 8(*c*) is a cross-sectional view illustrating a state in which the content liquid is foamed and dispensed in response to a press of the pump head portion.

FIG. 9(*a*) is a schematic perspective view of a porous member according to another embodiment.

FIG. 9(*b*) is a cross-sectional view of a main part of a mechanism for variably positioning a passage surface according to another embodiment.

FIG. 10(*a*) is a cross-sectional view illustrating a foam dispenser according to another embodiment in which a foam dispensing unit according to another preferred embodiment of the present invention is attached to a neck portion of a dispenser body.

FIG. 10(*b*) is a cross-sectional view illustrating the foam dispenser according to another embodiment in which a foam dispensing unit according to another preferred embodiment of the present invention is attached to a neck portion of a dispenser body.

FIG. 11(*a*) is a schematic perspective view of a mechanism for variably positioning a passage surface according to another embodiment.

FIG. 11(*b*) is a schematic perspective view of a mechanism for variably positioning a passage surface according to still another embodiment.

DESCRIPTION OF EMBODIMENTS

In conventional foam dispensing units as described above, the porous member for foaming the content liquid mixed with air is fixedly attached to the foaming flow channel. For this reason, if a long period of time, for example, about several tens of hours to several days, elapses after the foam dispenser is used (i.e. the content liquid is passed through the porous member and foamed) before the foam dispenser is next used, the content liquid adhering to the porous member dries out and solidifies, which is likely to cause clogging. If clogging occurs in the porous member, an undue pressing force needs to be applied to, for example, the pump head portion or the dispenser body when the foam dispenser is next used, which makes it difficult to stably and smoothly perform an operation of dispensing the content liquid.

Also, in recent years, for the purpose of reducing environmental burden and the like, refilling the dispenser body with a content liquid is commonly performed so that the foam dispenser can be used for a long period of time. However, extraneous matter such as dirt and dust may enter the dispenser body when the dispenser body is refilled with a content liquid. If extraneous matter such as dirt and dust enters the dispenser body, the extraneous matter is trapped in the pores of the porous member when the content liquid is dispensed, which is more likely to cause clogging. Under these circumstances, there is a need for the development of a technique for allowing an operation of dispensing the content liquid to be repeated stably and smoothly for a long period of time by configuring the porous member provided in the foaming flow channel of the foam dispensing unit such that clogging is unlikely to occur and that even if clogging occurs, the clogging can be removed.

The present invention relates to a foam dispensing unit in which the porous member provided in the foaming flow channel is configured such that clogging is unlikely to occur and that even if clogging occurs, the clogging can be removed and with which the dispensation of the content liquid can be repeated stably and smoothly for a long period of time.

The present invention relates to a foam dispensing unit that dispenses a content liquid in a foamed state by causing the content liquid pumped out via a liquid flow channel to pass through a porous member provided in a foaming flow channel together with air. The foam dispensing unit includes a mechanism for variably positioning a passage surface, the mechanism rotatably holding the porous member in the foaming flow channel to variably position a content liquid passage surface of the porous member.

As shown in FIG. 1, a foam dispensing unit 10 according to a preferred embodiment of the present invention is a unit for a so-called pump foamer that is incorporated on use into, for example, a pump foamer as a foam dispenser 50. Similarly to a conventional unit for a pump foamer, the foam dispensing unit 10 is mounted on a neck portion 52 of a dispenser body 51 of the foam dispenser 50, and has a function of dispensing a content liquid in the form of foam by mixing the content liquid with air to foam the content liquid. Specifically, the foam dispensing unit 10 includes a pump mechanism, which is attached to a cap portion 11 mounted on the neck portion 52 of the dispenser body 51 and includes a cylinder portion 15 in which a liquid piston 14 for drawing, pressurizing and discharging a content liquid and an air piston 13 for drawing, pressurizing and discharging air are concentrically arranged in series. In response to a push of a pump head portion 18 protruding upward from the cap portion 11, the pistons 13 and 14 of the pump mechanism are actuated to pressurize the content liquid and air in the cylinder portion 15 and discharge them to a mixing chamber 19 that is provided on the pump-out side and serves as a confluence space where the content liquid and air are mixed, and the resulting mixture is passed through a foaming flow channel 24 including a porous member 29, and is thereby foamed and dispensed to the outside through a dispensing outlet 18*a*.

The foam dispensing unit 10 according to the present embodiment has a function of effectively suppressing the occurrence of clogging in the porous member 29 for foaming the content liquid that is provided in the foaming flow channel 24, and also has a function of, even if clogging occurs in the porous member 29, removing the clogging so that an operation of dispensing the content liquid is performed smoothly.

As shown in FIGS. 1 and 2, the foam dispensing unit 10 according to the present embodiment is a foam dispensing unit that dispenses a content liquid in a foamed state by causing the content liquid pumped out via a liquid flow channel 73 to pass through the porous member 29 provided in the foaming flow channel 24 together with air. The foam dispensing unit 10 includes a mechanism for variably positioning a passage surface, 40 (hereinafter also simply referred to as "mechanism 40") in the foaming flow channel 24, and the mechanism 40 rotatably holds the porous member 29 so as to variably position a content liquid passage surface of the porous member 29, through which the content liquid passes, preferably such that an upstream passage surface in a pass-through direction of the porous member 29 is replaced by a downstream passage surface in the pass-through direction of the porous member 29 when the content liquid and air pass through the porous member 29.

Also, in the present embodiment, the mechanism for variably positioning a passage surface, 40 preferably includes a loosely holding region 41 that is formed in the foaming flow channel 24 and configured to movably hold the porous member 29 and the porous member 29 that is loosely mounted in the loosely holding region 41. The porous member 29 preferably has a spherical shape, and is preferably configured to freely rotate inside the loosely holding region 41 due to the action of a stream of content liquid passing through the loosely holding region 41 so as to variably position the content liquid passage surface of the porous member 29 such that the upstream passage surface in the pass-through direction is replaced by the downstream passage surface in the pass-through direction.

Furthermore, in the present embodiment, the foam dispensing unit 10 includes the pump head portion 18 that is mounted on the neck portion 52 of the dispenser body 51 via the cap portion 11 (see FIG. 1) and is provided to be capable of reciprocal movement with respect to the cap portion 11. In response to a press of the pump head portion 18, the content liquid is pumped out from a liquid chamber 32 to the mixing chamber 19 via the liquid flow channel 23, and at the same time, air is pumped out from an air chamber 20 to the mixing chamber 19 via an air flow channel 21. The content liquid transferred to the mixing chamber 19 is foamed in the foaming flow channel 24 extending from the mixing chamber 19 to the dispensing outlet 18*a*, and then dispensed.

Furthermore, the foam dispensing unit 10 includes: a cylinder portion 15 including an air cylinder 16 having a large diameter that is provided inside the dispenser body 51

(see FIG. 1) and a liquid cylinder 17 having a small diameter that is connectedly provided below the air cylinder 16; and a piston portion 12 including an air piston 13 having an air chamber-contacting outer circumferential portion 13*a* that slides along an inner circumferential surface of the air cylinder 16 while being in close contact with the inner circumferential surface of the air cylinder 16 and a liquid piston 14 having a liquid chamber-contacting outer circumferential portion 14*a* that slides along an inner circumferential surface of the liquid cylinder 17 while being in close contact with the inner circumferential surface of the liquid cylinder 17. In the present embodiment, the air piston 13 and the liquid piston 14 are configured to unitarily move up and down, with the air flow channel 21 being constantly open, in response to a press of the pump head portion 18, and a lower end inlet 22 of the air flow channel 21 is configured to be open to an interior of the liquid cylinder 17 at least while the pump head portion 18 is pressed down (see FIGS. 8(*a*) to 8(*c*)).

In the present embodiment, the cylinder portion 15 including the air cylinder 16 and the liquid cylinder 17 is unitarily attached to the cap portion 11. That is, the cylinder portion 15 is attached so as to extend downward from a ceiling portion 11*a* by fitting an upper end engaging portion 16*a* provided at an upper end rim portion of the air cylinder 16 provided in the upper part of the cylinder portion 15 into an inner engaged portion 11*b* provided at an inner rim portion of the ceiling portion 11*a* of the cap portion 11. A cylindrical guiding cylinder portion 26 vertically extending through the ceiling portion 11*a* is provided unitarily with the ceiling portion 11*a* of the cap portion 11. A hollow pipe portion 27 of the pump head portion 18 is inserted through the guiding cylinder portion 26 so as to be capable of sliding in up and down directions. External thread ribs 26*a* are provided on an outer circumferential surface of an upper half portion of the guiding cylinder portion 26 that is above the ceiling portion 11*a*. The foam dispensing unit 10 is configured to, as a result of screwing a screw skirt portion 27*a* of the pump head portion 18 into the external thread ribs 26*a*, be capable of holding the pump head portion 18 and the piston portion 12 unitarily attached to the pump head portion 18 at a bottom dead center position, when the foam dispenser 50 is in a distribution and sales before use (see FIG. 6).

The cap portion 11 is detachably mounted and fixed to the dispenser body 51 by screwing a mount skirt portion 11*c* extending downward from a rim portion of the ceiling portion 11*a* into external thread ribs 52*a* formed on an outer circumferential surface of the neck portion 52 of the dispenser body 51 (see FIG. 1). With this configuration, the foam dispensing unit 10 including the cylinder portion 15 attached to the cap portion 11, the piston portion 12 that slides along an inner circumferential surface of the cylinder portion 15, and the pump head portion 18 unitarily attached to the piston portion 12 is attached to the dispenser body 51.

In the present embodiment, as shown in FIG. 1, the pump head portion 18 includes a head body portion 28 and a hollow pipe portion 27. An engaging flange portion 27*b* is provided so as to extend outward from an upper end of the hollow pipe portion 27. The aforementioned screw skirt portion 27*a* is provided unitarily with the engaging flange portion 27*b* so as to extend downward from an outer rim portion of the engaging flange portion 27*b*. The head body portion 28 includes a dispensing nozzle portion 28*a* that horizontally extends and a connection pipe portion 28*b* that vertically extends. The connection pipe portion 28*b* is connected to the base end of the dispensing nozzle portion 28*a* on the opposite side of the dispensing outlet 18*a* provided at the tip. Outside the connection pipe portion 28*b*, a cylindrical engagement wall 28*c* is provided that is concentrically disposed apart from the connection pipe portion 28*b*.

The engaging flange portion 27*b* is fitted into a spacing between the connection pipe portion 28*b* and the cylindrical engagement wall 28*c* thereby to connect the upper end of the hollow pipe portion 27 to a bottom portion of the head body portion 28, and as a result, the pump head portion 18 is formed in which the hollow pipe portion 27 and the head body portion 28 are unitarily combined. With this configuration, an outer circumferential surface of the connection pipe portion 28*b* of the head body portion 28 comes into close contact with an inner circumferential surface of the upper end of the hollow pipe portion 27, and as a result, the foaming flow channel 24 is formed in which a hollow interior portion of the dispensing nozzle portion 28 and a hollow interior portion of the hollow pipe portion 27 are in fluid communication with each other. In the hollow pipe portion 27, the mechanism for variably positioning a passage surface, 40 (described later) including the loosely holding region 41 and the porous member 29 and the piston portion 12 including the air piston 13 and the liquid piston 14 are unitarily attached so as to be capable of moving up and down in response to a press of the pump head portion 18.

In the present embodiment, a substantially upper half portion of a cylindrical portion 13*b* of the air piston 13 is fitted to and mounted in a substantially lower half portion of the hollow pipe portion 27 thereby to unitarily attach the air piston 13 to the hollow pipe portion 27. The air piston 13 includes the cylindrical portion 13*b* that is hollow and elongated and therefore has a substantially cylindrical shape and the air chamber-contacting outer circumferential portion 13*a* that slides along the inner circumferential surface of the air cylinder 16 while being in close contact therewith. The air chamber-contacting outer circumferential portion 13*a* is unitarily formed with a rim portion of an annularly extending flange portion 13*c* provided so as to extend outward from an outer circumferential surface of a lower end of the cylindrical portion 13*b*. The air chamber-contacting outer circumferential portion 13*a* has a vertical cross-sectional shape that is curved to have a shallow concave facing outward and includes an upper close contact portion and a lower close contact portion. The air chamber-contacting outer circumferential portion 13*a* is configured to bring rim portions of the upper close contact portion and the lower close contact portion into close contact with the inner circumferential surface of the air cylinder 16 while elastically deforming the upper close contact portion and the lower close contact portion, thereby exhibiting a strong sealing function of a double-structure.

In the present embodiment, in the air cylinder 16, a hollow interior portion below the annularly extending flange portion 13*c* of the air piston 13 serves as the air chamber 20 where air to be pumped out to the mixing chamber 19 is stored. In the annularly extending flange portion 13*c* of the air piston 13, an air vent 13*d* for feeding air into the air chamber 20 when the pressure inside the air chamber 20 is brought to a negative pressure is provided so as to be capable of being opened and closed by a ball valve 13*e*.

In the present embodiment, the cylindrical portion 13*b* of the air piston 13 includes: an upper half mount portion 13*f* mounted in a substantially lower half portion of the hollow pipe portion 27 of the pump head portion 18; an intermediate enlarged diameter portion 13*g* provided between the upper half mount portion 13*f* and the annularly extending flange portion 13*c*; and a connection sleeve portion 13*h* provided so as to extend downward from the annularly extending flange portion 13*c*. The upper half mount portion 13*f* has an outer circumferential surface having a shape that substantially matches the shape of the inner circumferential surface of the substantially lower half portion of the hollow pipe portion 27. The upper half mount portion 13*f* is mounted to the substantially lower half portion of the hollow pipe portion 27, with its upper end being inserted into an inner space formed by a top inwardly hooked valve seat portion 27*c* that has an inverted L-shaped cross section and is provided in an intermediate portion of the hollow pipe portion 27 and also with a stepped portion 13*i* extending from the intermediate enlarged diameter portion 13*g* being abutted against the lower end of the hollow pipe portion 27.

The intermediate enlarged diameter portion 13*g* of the cylindrical portion 13*b* is formed to be thicker than the upper half mount portion 13*f*, and thus its outer circumferential surface is disposed radially outward of an outer circumferential surface of the upper half mount portion 13*f* via the stepped portion 13*i*. By pushing the upper half mount portion 13*f* into the substantially lower half portion of the hollow pipe portion 27 until the stepped portion 13*i* of the upper half mount portion 13*f* abuts against the lower end of the hollow pipe portion 27, the air piston 13 can be stably and unitarily connected to the hollow pipe portion 27 of the pump head portion 18. The intermediate enlarged diameter portion 13*g* is configured such that a corner between its upper end rim and the stepped portion 13*i* can abut against, from below, a connection corner between a cylinder wall portion 30*a* and an annularly extending wall portion 30*b* of a guiding aid member 30, which will be described later. With this configuration, when the user unscrews the screw skirt portion 27*a* of the foam dispenser 50 in the same state as in the distribution and sales in which the screw skirt portion 27*a* of the pump head portion 18 has been screwed into the upper half portion of the guiding cylinder portion 26 (shown in FIG. 6) in order to start to use the foam dispenser 50, the guiding aid member 30 is forced to move upward together with the piston portion 12 (the air piston 13) moving upward (see FIG. 7) until the pump head portion 18 and the piston portion 12 reach top dead center shown in FIG. 2.

The connection sleeve portion 13*h* of the cylindrical portion 13*b* is a substantially cylindrical portion for unitarily connecting an extension sleeve member 31, which is a member separate from the cylindrical portion 13*b*, to the lower end of the cylindrical portion 13*b*. The extension sleeve member 31 is a member for extending the air flow channel 21 downward so as to cause the inlet 22 of the air flow channel 21 to be open at a position below the annularly extending flange portion 13*c* of the air piston 13. The connection sleeve 13*h* has an inner diameter larger than the inner diameter of the upper half mount portion 13*f* and that of the intermediate enlarged diameter portion 13*g*. An enlarged diameter connection portion 31*a* of the extension sleeve member 31 is connected to the inside the connection sleeve portion 13*h* in an airtight manner, the enlarged diameter connection portion 31*a* having an outer circumferential surface having a shape that is substantially the same as the shape of the inner circumferential surface of the connection sleeve portion 13*h*. With this configuration, when the pump head portion 18 is at top dead center before it is pressed down, a lower end of an extension body portion 31*b* provided below the enlarged diameter connection portion 31*a* of the extension sleeve member 31 is disposed proximate to an interior bottom wall 25 of a reduced diameter connection portion between the air cylinder 16 and the liquid cylinder 17 of the cylinder portion 15, preferably proximate to a boundary between the interior bottom wall 25 of the reduced diameter connection portion and the liquid cylinder 17. In the first embodiment, the interior bottom wall 25 of the reduced diameter connection portion between the air cylinder 16 and the liquid cylinder 17 includes an interior bottom surface 25*a* having a tapered shape that is sloped downward from a lower end rim portion of the air cylinder 16 toward an upper end rim portion of the liquid cylinder 17.

In the present embodiment, the extension body portion 31*b* of the extension sleeve member 31 has an inner diameter that is the same or substantially the same as the inner diameter of the upper half mount portion 13*f* and the intermediate enlarged diameter portion 13*g* of the cylindrical portion 13*b* of the air piston 13. The liquid piston 14 is unitarily connected to the cylindrical portion 13*b* of the air piston 13, with a liquid chamber cylindrical portion 14*b* of the liquid piston 14 being continuously inserted through a hollow interior portion of the extension body portion 31*b* of the extension sleeve member 31 and a hollow interior portion extending through the upper half mount portion 13*f* and the intermediate enlarged diameter portion 13*g* of the cylindrical portion 13*b* of the air piston 13.

In the present embodiment, the liquid piston 14 is a substantially cylindrical piston member. The liquid piston 14 includes the liquid chamber cylindrical portion 14*b* having an elongated substantially cylindrical shape and the liquid chamber-contacting outer circumferential portion 14*a* provided so as to extend outward from a lower end of the liquid chamber cylindrical portion 14*b*. The liquid chamber cylindrical portion 14*b* has a length extending from an upper intermediate portion of the upper half mount portion 13*f* of the air piston 13 to a lower end of the extension sleeve member 31 via the intermediate enlarged diameter portion 13*g*. The liquid chamber cylindrical portion 14*b* includes a portion having an outer circumferential surface having a shape that matches the shape of the inner circumferential surface of the upper half mount portion 13*f* and the intermediate enlarged diameter portion 13*g* of the air piston 13 and the shape of an inner circumferential surface of the extension body portion 31*b* of the extension sleeve member 31.

In the liquid chamber cylindrical portion 14*b* of the liquid piston 14, as also shown in FIG. 3, a plurality of venting grooves 14*c* are provided so as to be circumferentially spaced apart from each other on the outer circumferential surface of the liquid chamber cylindrical portion 14*b* in a portion extending from a lower end of the liquid chamber cylindrical portion 14*b* to an intermediate stepped portion 13*j* of the upper half mount portion 13*f* of the air piston 13. The venting grooves 14*c* are formed by notching the outer circumferential surface of the liquid chamber cylindrical portion 14*b* into elongated longitudinal grooves. The venting grooves 14*c* are in communication with upper venting grooves 13*k* formed in the outer circumferential surface of a portion above the intermediate stepped portion 13*j* of the upper half mount portion 13*f* of the air piston 13 via communicating pores extending through the intermediate stepped portion 13*j* of the upper half mount portion 13*f* of the air piston 13 (see FIGS. 2, 6 and 7). Similarly to the venting grooves 14*c* on the outer circumferential surface of the liquid chamber cylindrical portion 14*b*, a plurality of the upper venting grooves 13*k* are provided so as to be circumferentially spaced apart from each other by notching the outer circumferential surface into elongated longitudinal grooves. The upper venting grooves 13*k* are formed so as to extend from the intermediate stepped portion 13*j* of the upper half mount portion 13*f* of the air piston 13 along the outer circumferential surface of the upper half mount portion 13*f*, the upper end surface of the upper half mount portion 13*f*, and the inner circumferential surface of a portion extending into the top inwardly hooked valve seat portion 27*c* of the hollow pipe portion 27 of the pump head portion 18, thereby being in communication with the mixing chamber 19 inside the upper half mount portion 13*f*.

With the configuration described above, the air flow channel 21 is formed between the cylindrical portion 13*b* of the air piston 13 including the extension sleeve member 31 and the liquid chamber cylindrical portion 14*b* of the liquid piston 14 and between the cylindrical portion 13*b* and the hollow pipe portion 27 of the pump head portion 18. The air flow channel 21 extends from immediately above the liquid chamber-contacting outer circumferential portion 14*a* of the liquid piston 14 through the venting grooves 14*c* on the outer circumferential surface of the liquid chamber cylindrical portion 14*b* to the enlarged diameter connection portion 31*a* of the extension sleeve member 31, and further extends, through the venting grooves 14*c* above the enlarged diameter connection portion 31*a*, to the mixing chamber 19 via the communicating pores and the upper venting grooves 13*k*. The air flow channel 21 is formed with a lower end of the venting grooves 14*c* open as the lower end inlet 22, which lower end is open between the liquid chamber contacting outer circumferential portion 14*a* of the liquid piston 14 and the lower end of the extension body portion 31*b* of the extension sleeve member 31.

In the present embodiment, the liquid chamber-contacting outer circumferential portion 14*a* provided at the lower end of the liquid chamber cylindrical portion 14*b* of the liquid piston 14 slides up and down along the inner circumferential surface of the liquid cylinder 17 that has a small diameter and a cylindrical shape while being in close contact with the inner circumferential surface of the liquid cylinder 17. With this configuration, a hollow interior portion of the liquid cylinder 17 located below the liquid chamber-contacting outer circumferential portion 14*a* is insulated from the air chamber 20. Also, with this configuration, the hollow interior portion of the liquid cylinder 17 located below the liquid chamber-contacting outer circumferential portion 14*a* forms, together with the hollow interior portion of the liquid chamber cylindrical portion 14*b* of the liquid piston 14, the liquid chamber 32 which contains the content liquid to be pumped out to the mixing chamber 19 and also serves as the liquid flow channel 23. Similarly to the air chamber-contacting outer circumferential portion 13*a*, the liquid chamber-contacting outer circumferential portion 14*a* has a vertical cross-sectional shape that is curved to have a shallow concave facing outward and includes an upper close contact portion and a lower close contact portion. The liquid chamber-contacting outer circumferential portion 14*a* is configured to bring rim portions of the upper close contact portion and the lower close contact portion into close contact with the inner circumferential surface of the liquid cylinder 17 while elastically deforming the upper close contact portion and the lower close contact portion, thereby exhibiting a strong sealing function of double-structure.

Furthermore, in the present embodiment, a spring member 34 such as a coiled spring is attached inside the liquid cylinder 17 between a base end of the liquid chamber-contacting outer circumferential portion 14*a* and a liquid chamber inlet valve 33 (which will be described later) provided at a lower end of the liquid cylinder 17. The spring member 34 biases the pump head portion 18 and the piston portion 12 upward to top dead center against a pressing force applied by the user pressing down the pump head portion 18 upon use of the foam dispenser 50.

Furthermore, in the present embodiment, the liquid chamber cylindrical portion 14*b* of the liquid piston 14 is inserted into a hollow interior portion of the air piston 13 with its upper end being in contact with the upper intermediate portion of the upper half mount portion 13*f*. The upper end of the liquid chamber cylindrical portion 14*b* is provided with an upper end valve seat portion 14*d* with which a flow channel ball valve 35 comes into close contact, the flow channel ball valve 35 being configured to open and close the liquid flow channel 23. The flow channel ball valve 35 is provided such that it is capable of moving up and down inside the cylindrical portion 13*b* (the upper half mount portion 130 of the air piston 13 in a portion between the upper end valve seat portion 14*d* and the top inwardly hooked valve seat portion 27*c* provided at an intermediate portion of the hollow pipe portion 27 of the pump head portion 18. In a portion between the upper end valve seat portion 14*d* provided at the upper end of the liquid chamber cylindrical portion 14*b* of the liquid piston 14 and the mechanism for variably positioning a passage surface, 40 (which will be described later) provided in the hollow pipe portion 27 of the pump head portion 18, an interior region of the cylindrical portion 13*b* (the upper half mount portion 130 of the air piston 13 and an interior region surrounded by the top inwardly hooked valve seat portion 27*c* function as the mixing chamber 19 in which the air pumped out from the air chamber 20 and the content liquid pumped out from the liquid chamber 32 are mixed.

In the present embodiment, the lower end of the small-diameter liquid cylinder 17 is in communication with an inlet portion 17*b* having a reduced diameter, with an inverted substantially frusto-conical portion 17*a* interposed therebetween. With this configuration, the content liquid in the interior of the dispenser body 51 can flow into the liquid chamber 32 inside the liquid cylinder 17 through a lower end inlet 17*c* at a lower end of the inlet portion 17*b*. The liquid chamber inlet valve 33 is provided at the lower end of the liquid cylinder 17 and is supported on a stepped portion extending from the substantially frusto-conical portion 17*a*.

In the present embodiment, the liquid chamber inlet valve 33 is a valve body that is provided only at the lower end of the liquid cylinder 17 and does not include a portion that is inserted into the liquid piston 14. With this configuration, there is substantially no obstruction in the liquid flow channel 23 (the liquid chamber 32) formed by the liquid cylinder 17 and the liquid piston 14, and thus the content liquid stored in the liquid chamber 32 can be stably pumped out to the mixing chamber 19 in a predetermined amount when an operation of pressing the pump head portion 18 is performed. The liquid chamber inlet valve 33 also has a function of opening and closing the inlet portion 17*b* of the liquid cylinder 17 in a stable manner.

Specifically, as shown in FIGS. 4(*a*) and 4(*b*), the liquid chamber inlet valve 33 includes: a pair of attachment base portions 33*a* that each have an arcuate flat shape, are opposed to each other, and are radially spaced apart; a valve body supporting portion 33*d* including an upper cylindrical portion 33*b* and a lower gate-like portion 33*c* standing upright so as to straddle the pair of attachment base portions 33*a*; and a valve body 33*f* that is suspended from a center portion of the lower gate-like portion 33*c* to a position below the base portions 33*a* via an elastically biasing portion 33*e*. The valve body 33*f* has a tapered shape in which the diameter of the outer circumferential surface decreases downward. The liquid chamber inlet valve 33 is attached to the lower end of the liquid cylinder 17 by placing the pair of attachment base portions 33*a* on the stepped portion of the substantially frusto-conical portion 17*a* (see FIGS. 2, 6, and 7). A lower end of the spring member 34 having an upper end abutting against the projecting base end of the liquid chamber-contacting outer circumferential portion 14*a* of the liquid piston 14 abuts against the upper surfaces of the pair of attachment base portions 33*a*. Due to the biasing force of the spring member 34, the attachment base portions 33*a* are pressed against the stepped portion of the substantially frusto-conical portion 17*a* and are firmly kept in close contact with the stepped portion. With this configuration, the liquid chamber inlet valve 33 is attached to the lower end of the liquid cylinder 17 in a stable manner. Also, with this configuration, the tapered outer circumferential surface of the valve body 33*f* of the liquid chamber inlet valve 33 can be smoothly brought into close contact with the inner circumferential surface of the inverted substantially frusto-conical portion 17*a* by the biasing force from the elastically biasing portion 33*e*, and thus the inlet portion 17*b* of the liquid cylinder 17 can be effectively closed.

When the pressure inside the liquid chamber 32 formed by the liquid cylinder 17 and the liquid piston 14 is a positive pressure, the liquid chamber inlet valve 33 closes the inlet portion 17*b* by holding the valve body 33*f* in close contact with the inner circumferential surface of the substantially frusto-conical portion 17*a*. When the pressure inside the liquid chamber 32 formed by the liquid cylinder 17 and the liquid piston 14 is brought to a negative pressure, the elastically biasing portion 33*e* contracts and deforms against the biasing force of the elastically biasing portion 33*e* so as to move the valve body 33*f* apart from the inner circumferential surface of the substantially frusto-conical portion 17*a*, and as a result, the liquid chamber inlet valve 33 opens the inlet portion 17*b*. The content liquid contained in the dispenser body 51 can be thus allowed to flow into the liquid chamber 32 inside the liquid cylinder 17.

In the present embodiment, as shown in FIGS. 2, 6, and 7, a guiding aid member 30 including a cylinder wall portion 30*a*, an annularly extending wall portion 30*b*, and a close contact outer circumferential wall portion 30*c* is disposed inside the air cylinder 16, in a stacked manner above the annularly extending flange portion 13*c* and the air chamber-contacting outer circumferential portion 13*a* of the air piston 13. For attachment of the guiding aid member 30, the cylinder wall portion 30*a* is inserted in a spacing between the guiding cylinder portion 26 of the cap portion 11 and the hollow pipe portion 27 of the pump head portion 18 inserted through the guiding cylinder portion 26. Also, the guiding aid member 30 is attached, with an upper end of the inserted cylinder wall portion 30*a* extending to above the guiding cylinder portion 26. The cylinder wall portion 30*a* fills a gap between the guiding cylinder portion 26 of the cap portion 11 and the hollow pipe portion 27 of the pump head portion 18, and thus the guiding aid member 30 can guide the hollow pipe portion 27 to slide in up and down directions in a further stable manner. It is also possible to effectively avoid a flow of external water into the air cylinder 16 via the gap between the guiding cylinder portion 26 and the hollow pipe portion 27.

The guiding aid member 30 is configured such that, in the distribution and sales of the foam dispenser 50 before use, as shown in FIG. 6, the screw skirt portion 27*a* of the pump head portion 18 is screwed into the upper half portion of the guiding cylinder portion 26, and substantially the entirety of the cylinder wall portion 30*a* is housed in the cap portion 11. The guiding aid member 30 is configured such that, when the user unscrews the screw skirt portion 27*a* at the start of use of the foam dispenser 50, as shown in FIG. 7, a corner portion of the intermediate enlarged diameter portion 13*g* of the cylindrical portion 13*b* of the air piston 13 abuts against, from below, a connection corner between the cylinder wall portion 30*a* and the annularly extending wall portion 30*b* while the pump head portion 18 and the piston portion 12 move upward under the biasing force of the spring member 34. The guiding aid member 30 is thereby forced to move upward until an upper surface of a base end of the annularly extending wall portion 30*b* that is on the cylinder wall portion 30*a* side abuts against a lower end 26*b* of the guiding cylinder portion 26 of the cap portion 11. Also, when the pump head portion 18 and the piston portion 12 move upward to top dead center, as shown in FIG. 2, the guiding aid member 30 is disposed with an upper end of the cylinder wall portion 30*a* extending to be above the guiding cylinder portion 26 by a certain extension length.

After the pump head portion 18 and the piston portion 12 have moved to top dead center, the guiding aid member 30 can be held at the raised position by the close contact outer circumferential wall portion 30*c*, which is connected to an outer rim portion of the annularly extending wall portion 30*b*, coming into close contact with the inner circumferential surface of the air cylinder 16. The guiding aid member 30 including the cylinder wall portion 30*a* whose upper end extends to be above the guiding cylinder portion 26 by a certain extension length is held at the raised position until the screw skirt portion 27*a* of the pump head portion 18 is again screwed into the upper half portion of the guiding cylinder portion 26, for example, in order to store the foam dispenser 50, and it is thereby possible to continuously prevent external water from flowing into the air cylinder 16.

In the present embodiment, the porous member 29 for foaming the content liquid is provided in the foaming flow channel 24 of the foam dispensing unit 10. The foaming flow channel 24 of the foam dispensing unit 10 also includes the mechanism for variably positioning a passage surface, 40 and the mechanism 40 is configured to, when a mixture of the content liquid and air mixed in the mixing chamber 19 passes through the porous member 29, variably position the content liquid passage surface of the porous member 29 through which the content liquid passes, for example, such that the upstream passage surface in the pass-through direction of the porous member 29 is replaced by the downstream passage surface in the pass-through direction of the porous member 29. As described above, the mechanism for variably positioning a passage surface, 40 preferably includes the loosely holding region 41 that is formed in the foaming flow channel 24 and configured to movably hold the porous member 29, and the porous member 29 that is loosely mounted in the loosely holding region 41. The porous member 29 preferably has a spherical shape.

In the present embodiment, the loosely holding region 41 constituting the mechanism for variably positioning a passage surface, 40 is formed by mounting a cylindrical holder 42 between a lower end of the connection pipe portion 28*b* and the top inwardly hooked valve seat portion 27*c* in an intermediate portion of the hollow pipe portion 27 in the foaming flow channel 24 formed by the connection pipe portion 28*b* of the head body portion 28 and the hollow pipe portion 27 being in fluid communication with each other via the connection pipe portion 28*b*. The cylindrical holder 42 is a cylindrical member including open upper and lower surfaces and having an outer diameter that is the same as the inner diameter of the hollow pipe portion 27 and an inner diameter that is the same as the inner diameter of the connection pipe portion 28*b*.

The cylindrical holder 42 includes a reduced diameter projecting portion 42*a* that projects inward from an upper inner surface of the cylindrical holder 42. The reduced diameter projecting portion 42*a* is provided to project inward from the inner surface of the cylindrical holder 42 such that its inner diameter is smaller than the outer diameter of the spherical porous member 29. The cylindrical holder 42 is interposed between the lower end of the connection pipe portion 28*b* and the top inwardly hooked valve seat portion 27*c* of the hollow pipe portion 27 so that the cylindrical holder 42 is unitarily attached. With this configuration, the loosely holding region 41 that movably and loosely holds the porous member 29 while preventing the porous member 29 from escaping is formed between the top inwardly hooked valve seat portion 27*c* and the reduced diameter projecting portion 42*a* of the cylindrical holder 42.

As shown in FIG. 5, in the present embodiment, the porous member 29 constituting the mechanism 40 for variably positioning a passage surface is a hollow spherical porous member having a spherical outer contour portion 29*a* in which a large number of small through holes 29*b* are formed. The porous member 29 has an outer diameter that is smaller than the inner diameter of the cylindrical holder 42 mounted in the foaming flow channel 24 but is larger than the inner diameters of the reduced diameter projecting portion 42*a* of the cylindrical holder 42 and the inner diameter of the top inwardly hooked valve seat portion 27*c* of the hollow pipe portion 27.

With this configuration, preferably by a stream of content liquid fed together with air from the mixing chamber 19, the porous member 29 can loosely move up, down, right, and left and freely rotate in any direction in the loosely holding region 41 formed by the cylindrical holder 42 and the top inwardly hooked valve seat portion 27*c* without escaping from the loosely holding region 41. Also, with this configuration, the porous member 29 can, for example, replace the upstream passage surface in the pass-through direction with the downstream passage surface in the pass-through direction by rotating when the mixture of the content liquid and air mixed in the mixing chamber 19 passes through the porous member 29. The porous member 29 allows the mixture of content liquid and air to pass therethrough so as to, for example, traverse the inside thereof from an outer circumferential surface region toward another outer circumferential surface region, these outer circumferential surfaces facing away each other in a radial direction, via a meshed outer circumferential surface having a large number of through holes 29*b* to thereby foam the mixture into a fine foam. The porous member 29 may be a solid spherical porous member, rather than a hollow spherical porous member.

Here, as the porous member, it is also possible to use a porous member made of, for example, a meshed material. Also, as the porous member, it is preferable to use a molded mesh composed of an outer circumferential frame and a mesh plate. It is also possible to use, as the porous member, a foam member such as a sponge, or a member obtained by molding a sintered metal, a perforated metal, a filter or a net molded into a spherical or cylindrical shape, or the like.

As shown in FIG. 6, before the foam dispenser 50 is used, the foam dispensing unit 10 according to the present embodiment configured as described above has a compact shape during distribution and sales of the foam dispenser 50 as a result of the screw skirt portion 27*a* of the pump head portion 18 being screwed into the upper half portion of the guiding cylinder portion 26. When a user who has purchased the foam dispenser 50 unscrews the pump head portion 18 that has been screwed into the guiding cylinder portion 26, as shown in FIG. 7, the pump head portion 18 moves upward together with the piston portion 12 due to the elastically biasing force of the spring member 34 provided inside the liquid cylinder 17. As shown in FIG. 2, when the upper surface of the base end of the annularly extending wall portion 30*b* of the guiding aid member 30 (which upper surface is on the cylinder wall portion 30*a* side) abuts against the lower end 26*b* of the guiding cylinder portion 26 of the cap portion 11, the pump head portion 18 moving upward together with the piston portion 12 is positioned at top dead center and no longer moves upward. When at the top dead center, the liquid chamber-contacting outer circumferential portion 14*a* at the lower end of the liquid piston 14 is in close contact with the inner circumferential surface of the liquid cylinder 17 at an upper end of the liquid cylinder 17, and the lower end of the extension sleeve member 31 is brought proximate to the interior bottom wall 25 at a reduced diameter stepped portion between the air cylinder 16 and the liquid cylinder 17. As a result, the lower end inlet 22 of the air flow channel 21 is also brought proximate to the interior bottom wall 25 at the reduced diameter stepped portion.

As described above, after the pump head portion 18 has reached top dead center together with the piston portion 12, the guiding aid member 30 brings the close contact outer circumferential wall portion 30*c* into close contact with the inner circumferential surface of the air cylinder 16, and thus maintains a state in which the upper surface of the base end of the annularly extending wall portion 30*b* (which upper surface is on the cylinder wall portion 30*a* side) is in abutment with the lower end 26*b* of the guiding cylinder portion 26 of the cap portion 11. Accordingly, when the operation of pressing the pump head portion 18 is then performed repeatedly, the pump head portion 18 moves upward together with the piston portion 12 to cause the corner portion of the intermediate enlarged diameter portion 13*g* of the cylindrical portion 13*b* of the air piston 13 to abut against, from below, the connection corner between the cylinder wall portion 30*a* and the annularly extending wall portion 30*b* of the guiding aid member 30, and thereby the pump head portion 18 reaches top dead center.

In the present embodiment, by repeatedly applying a pressing force to the pump head portion 18 of the foam dispensing unit 10 in which the pump head portion 18 has reached top dead center together with the piston portion 12 so as to use the foam dispenser 50, it is possible to foam the mixture of content liquid and air and dispense the foamed mixture from the dispensing outlet 18*a* at the tip of the dispensing nozzle portion 28*a* of the head body portion 28.

More specifically, according to the present embodiment, the pump head portion 18 is idly pressed a plurality of times until the liquid chamber 32 formed by the liquid cylinder 17 and the liquid piston 14 is filled with the content liquid. After the liquid chamber 32 is filled with the content liquid, the operation of pressing the pump head portion 18 is further performed. The lower end inlet 22 of the air flow channel 21 formed by the lower end of the venting grooves 14*c* formed on the outer circumferential surface of the liquid chamber cylindrical portion 14*b* of the liquid piston 14 remains open (see FIG. 2). Thus, as shown in FIGS. 8(*a*) and 8(*b*), in response to the movement of the air piston 13 downward as a result of a push of the pump head portion 18, the air chamber 20 is pressurized to push out the air inside the air chamber 20, and the air is thus pumped out to the mixing chamber 19 via the air flow channel 21. Also, in response to the movement of the liquid piston 14 downward as a result of a push of the pump head portion 18, the liquid chamber 32 is pressurized, and the content liquid in the liquid chamber 32 is thus pumped out to the mixing chamber 19 via the liquid flow channel 23 while the flow channel ball valve 35 having been in close contact with the upper end valve seat portion 14*d* is moved upward.

The content liquid and air pumped out to the mixing chamber 19 are mixed in the mixing chamber 19, and allowed to pass through the porous member 29 provided in the loosely holding region 41 of the foaming flow channel 24 to thereby foam. After that, the foamed content liquid is dispensed from the dispensing outlet 18*a* at the tip of the pump head portion 18 via the foaming flow channel 24.

When a single stroke of a pressing operation has been performed by pressing down the pump head portion 18 until the air chamber-contacting outer circumferential portion 13*a* of the air piston 13 comes close to the interior bottom wall 25 at the reduced diameter stepped portion between the air cylinder 16 and the liquid cylinder 17 (see FIG. 8(*c*)), the pressed pump head portion 18 is released. When the pressed pump head portion 18 is released, the air piston 13 and the liquid piston 14 are forced to move upward together with the pump head portion 18 by the biasing force of the spring member 34. In response thereto, the pressure inside the air chamber 20 and the pressure inside the liquid chamber 32 are brought to a negative pressure, and the ball valve 13*e* provided in the annularly extending flange portion 13*c* of the air piston 13 is opened, which allows ambient air to flow into the air chamber 20 via the air vent 13*d*. Also, the flow channel ball valve 35 comes into close contact with the upper end valve seat portion 14*d* of the upper end of the liquid piston 14 to close the liquid flow channel 23, and at the same time, the valve body 33*f* of the liquid chamber inlet valve 33 provided in the lower end of the liquid cylinder 17 moves upward against the biasing force from the elastically biasing portion 33*e*. In response thereto, the tapered outer circumferential surface of the valve body 33*f* in close contact with the substantially frusto-conical portion 17*a* is apart therefrom to open the inlet portion 17*b* of the liquid cylinder 17. Accordingly, the content liquid contained in the dispenser body 51 can smoothly flow into the liquid chamber 32 via the inlet portion 17*b*.

With the configuration described above, in the foam dispensing unit 10 according to the present embodiment, the air flow channel 21 is constantly open without a complex mechanism for opening and closing the inlet of the air flow channel, and thus the content liquid and air can be stably pumped out to the mixing chamber 19 at a predetermined gas-to-liquid ratio and foamed with a simpler configuration.

With the foam dispensing unit 10 according to the present embodiment configured as described above, the porous member 29 provided in the foaming flow channel 24 is unlikely to be clogged, and even if clogging occurs in the porous member 29, the clogging can be removed. Accordingly, the operation of dispensing the content liquid can be performed smoothly in a stable manner for a long period of time.

Specifically, according to the present embodiment, the foam dispensing unit 10 includes the mechanism for variably positioning a passage surface, 40 that includes the loosely holding region 41 configured to movably hold the porous member 29 in the foaming flow channel 24, and the porous member 29 loosely mounted in the loosely holding region 41.

Accordingly, with the present embodiment, when the content liquid mixed with air passes through the porous member 29 for foaming the content liquid, the porous member 29 loosely moves up, down, right and left and freely rotates inside the loosely holding region 41, preferably by the stream passing through the porous member 29, and the content liquid passage surface of the porous member 29 is thus variably positioned, preferably so that the content liquid passage surface of the porous member 29 constantly moves without the upstream passage surface in the pass-through direction through which the content liquid is introduced being held at a predetermined position. Thus, the porous member 29 is configured to be capable of changing positions in the circumferential direction preferably such that the upstream passage surface in the pass-through direction is replaced by the downstream passage surface in the pass-through direction. Also, with this configuration, it is possible to effectively avoid a situation in which extraneous matter such as dirt and dust contained in the content liquid passing through the porous member 29 is trapped in through holes 29*b* on the upstream passage surface in the pass-through direction through which the content liquid is introduced to thereby clog the porous member 29.

Also, even if clogging occurs in the porous member 29 as a result of extraneous matter such as dirt and dust being trapped in the through holes 29*b* on the upstream surface in the pass-through direction through which the content liquid is introduced, the porous member 29 loosely moves up, down, right, and left and freely rotates inside the loosely holding region 41, whereby the clogged upstream passage surface in the pass-through direction is preferably replaced by the downstream passage surface in the pass-through direction through which the content liquid is discharged. Accordingly, the clogged surface receives a flow of content liquid flowing radially outward from the center of the porous member 29 when the clogged surface is moved downstream in the pass-through direction. Due to the flow of content liquid flowing radially outward, the extraneous matter such as dirt and dust trapped in the through holes 29*b* is radially forced out and removed, and thus the clogging can be easily removed.

As a result, with the foam dispensing unit 10 according to the present embodiment, it is possible to stably and smoothly repeat the operation of dispensing the content liquid over a long period of time without causing clogging in the porous member 29 provided in the foaming flow channel 24.

Further, with the foam dispensing unit 10 according to the present embodiment, because the extension sleeve member 31 is provided on the air piston 13, the lower end inlet 22 of the air flow channel 21 is open below the lower end of the cylindrical portion 13*b* of the air piston 13 having the annularly extending flange portion 13*c* projecting therefrom. With this configuration, the lower end inlet 22 of the air flow channel 21 is open to the interior of the liquid cylinder 17 at least while the pump head portion 18 is pressed down. Also, with this configuration, when the pump head portion 18 is pressed down, the air in the air chamber 20 passes through a narrow gap between the outer circumferential surface of the extension sleeve member 31 and the inner circumferential surface of the liquid cylinder 17, and then reaches the lower end inlet 22 of the air flow channel 21, and as a result the pressure of the air inside the air chamber 20 is likely to increase. Accordingly, the ball valve 13*e* for closing the air vent 13*d* can be reliably actuated, and a predetermined amount of air can be pumped out to the mixing chamber 19 in a stable manner. When the pump head portion 18 is pressed down, the extension sleeve member 31 is inserted in a spacing between the liquid chamber cylindrical portion 14*b* of the liquid piston 14 and the liquid cylinder 17, and fills a gap of the spacing, and thus it is possible to prevent the liquid piston 14 from being displaced. With the configuration described above, the content liquid and air can be more stably pumped out to the mixing chamber 19 at a predetermined gas-to-liquid ratio and foamed.

Furthermore, with the foam dispensing unit 10 according to the present embodiment, even if water enters the air chamber 20 by, for example, using the foam dispenser 50 in a bathroom or the like, the water that has entered the air chamber 20 is discharged, and it is therefore possible to prevent the water that has entered the air chamber 20 from being stored in the air chamber 20 over a long period of time. Specifically, according to the present embodiment, because the extension sleeve member 31 is provided, the lower end inlet 22 of the air flow channel 21 is open to the interior of the liquid cylinder 17 at least while the pump head portion 18 is pressed down. Accordingly, an press of the pump head portion 18 to feed the air in the air chamber 20 into the mixing chamber 19 also can cause water that has entered the air chamber 20 and is stored on the interior bottom wall 25 at the reduced diameter stepped portion at the bottom portion of the air chamber 20 to flow into the liquid cylinder 17, further to flow into the air flow channel 21 from the lower end inlet 22 together with air, and finally to be pumped out to the mixing chamber 19 via the air flow channel 21. The water pumped out to the mixing chamber 19 together with air is mixed with the content liquid and air in the mixing chamber 19, passed through the porous member 29 and foamed. After that, the water is dispensed together with the content liquid from the dispensing outlet 18*a* at the tip of the pump head portion 18. Thus, even if water enters the air chamber 20, the water that has entered the air chamber 20 can be smoothly discharged, and it is therefore possible to effectively avoid contamination of the air chamber 20 with germs, putrefaction of the water that has entered the air chamber 20, and the occurrence of odor.

Furthermore, with the foam dispensing unit 10 according to the present embodiment, if a bactericidal component or an antimicrobial component is incorporated in the content liquid to be dispensed, the inside of the air chamber 20 is sterilized by feeding the content liquid into the air chamber 20, and thus the foam dispenser 50 can be used more hygienically. Specifically, according to the present embodiment, a complex mechanism for opening and closing the inlet of the air flow channel is not provided, and the lower end inlet 22 of the air flow channel 21 remains open even after the pressed pump head portion 18 is released. Accordingly, when the pressed pump head portion 18 is released to allow the air piston 13 to move upward to thereby reduce the pressure inside the air chamber 20 to a negative pressure, the content liquid remaining in the foaming flow channel 24 and the like can be caused to flow backward via the air flow channel 21 by the drawing force caused by the negative pressure and fed from the lower end inlet 22 to the air chamber 20. Taking advantage of the bactericidal action or antimicrobial action of the content liquid fed into the air chamber 20, the foam dispenser 50 can be used hygienically for a long period of time. The amount of backflow of the content liquid can be adjusted by, for example, the flow channel area, the flow channel length and the like of the air flow channel 21.

The foam dispensing unit 10 according to the present embodiment can be designed to variably change the mixing ratio as appropriate. For example, the foam dispensing unit 10 can be designed as follows: when the operation of pressing the pump head portion 18 is performed with a vertical stroke of 10 to 30 mm, air in an amount of 4 to 20 cc is fed from the air chamber 20 to the mixing chamber 19, and the content liquid in an amount of 0.3 to 1.55 cc is fed from the liquid chamber 32 to the mixing chamber 19. It is possible to make designs such that preferably 13 cc of air and 1 cc of the content liquid are fed, or that the ratio between air and content liquid that are fed is set to 13:1.

Within the above-described ranges, the foam dispensing unit 10 according to the present embodiment also can be designed as follows, for example: when the operation of pressing the pump head portion 18 is performed with a vertical stroke of 25 mm, air in an amount of 13 cc is fed from the air chamber 20 to the mixing chamber 19, and the content liquid in an amount of 1 cc is fed from the liquid chamber 32 to the mixing chamber 19. For such feeds, it is possible to design, for example, the neck portion 52 of the dispenser body 51 to have an opening inner diameter of φ29.5 mm, the dispenser body 51 to have a maximum width of 90 mm, and the air cylinder 16 to have an outer diameter of around φ29.4 mm so that 0.52 cc/mm of air and 0.04 cc/mm of content liquid can be fed per mm of vertical stroke.

With this configuration, the diameter of the air cylinder 16 can be reduced as compared with a conventional foam dispensing unit. For a conventional foam dispensing unit, for example, the neck portion of the dispenser body is designed to have an opening inner diameter of φ36.1 mm, the dispenser body is designed to have a maximum width of 90 mm, and the air cylinder is designed to have an outer diameter of φ34.9 mm, so that 0.72 cc/mm or air and 0.056 cc/mm of content liquid can be fed per mm of vertical stroke in order to feed 13 cc of air from the air chamber and 1 cc of content liquid from the liquid chamber to the mixing chamber by a vertical stroke of, for example, 18 mm. Also, with this configuration, in the foam dispensing unit 10 according to the present embodiment, the stroke can be lengthened to exert an inertial force during a pressing operation, and the resistance when the content liquid is foamed and dispensed can be reduced.

Further, the reduced diameter of the air cylinder 16 can reduce the opening inner diameter of the neck portion 52 of the dispenser body 51 in turn, which not only reduces the amount of resin but also improves the dimensional stability of the opening inner diameter of the neck portion 52 of the dispenser body 51. In the case where the dispenser body is molded by blow-molding using the same amount of resin, a smaller opening inner diameter of the neck portion of the dispenser body provides a better shaping property when the thickness of the neck portion is finished with a blow pin, resulting in excellent dimensional stability.

Furthermore, if the opening inner diameter of the neck portion 52 of the dispenser body 51 is small, the parison diameter can be reduced, and as a result, the width of a pinch-off portion at the bottom of the dispenser body 51 can be narrowed, which makes it possible to mold a dispenser having an excellent environmental stress cracking resistance (ESCR).

FIGS. 9(*a*) and 9(*b*) show a porous member 43 and a mechanism for variably positioning a passage surface, 44 according to another preferred embodiment of the present invention. The porous member 43 according to another embodiment shown in FIG. 9(*a*) has, for example, a columnar or cylindrical shape and also has a plurality of mesh pores formed on the outer circumferential surface. As shown in FIG. 9(*b*), the porous member 43 shown in FIG. 9(*a*) is loosely provided so as to be capable of rotating in the circumferential direction in a loosely holding region 45 that is a portion between the lower end of the connection pipe portion 28*b* and the top inwardly hooked valve seat portion 27*c* of the hollow pipe portion 27 in the foaming flow channel 24 formed in the head body portion 28. The mechanism for variably positioning a passage surface, 44 is thereby formed.

In the mechanism for variably positioning a passage surface, 44 shown in FIG. 9(*b*), the cylindrical holder is not mounted in the portion between the lower end of the connection pipe portion 28*b* and the top inwardly hooked valve seat portion 27*c*, and an inner circumferential surface of the hollow pipe portion 27 serves as an inner circumferential surface of the loosely holding region 45. The porous member 43 has, for example, a rectangular upper surface sized to fit in a circular hollow cross section of the hollow pipe portion 27 and is loosely mounted in the loosely holding region 45 so as to be capable of rotation with its central axis being substantially horizontally disposed. Also, the porous member 43 is configured such that, for example, a corner portion of the rectangular upper surface abuts against the lower end of the connection pipe portion 28*b* so as to prevent the porous member 43 from escaping upward from the loosely holding region 45.

In a foam dispensing unit including the mechanism for variably positioning a passage surface, 44 shown in FIG. 9(*b*) as well, the porous member 43 rotates in the circumferential direction in the loosely holding region 45 by a stream of the content liquid mixed with air passing through the porous member 43. Accordingly, the porous member 43 constantly moves while variably positioning the content liquid passage surface, and the upstream passage surface in the pass-through direction through which the content liquid is introduced is not held at a predetermined position. Further, with this configuration, the porous member 43 changes positions in the circumferential direction, preferably such that the upstream passage surface in the pass-through direction is replaced by the downstream passage surface in the pass-through direction. Accordingly, the same advantageous effects as those of the foam dispensing unit of the present embodiment described hereinbefore can be obtained.

The present invention is not limited to the embodiments given above, and various modifications can be made to the present invention. For example, the foam dispensing unit including the mechanism for variably positioning a passage surface according to the present invention is not limited to a unit for a pump foamer that, in response to a press of the pump head portion, pumps out the content liquid and air from the liquid chamber and the air chamber, respectively, to the mixing chamber at the same time, foams the content liquid in the foaming flow channel extending from the mixing chamber to the dispensing outlet, and then dispenses the foamed content liquid. The mechanism for variably positioning a passage surface also can be provided in a foaming flow channel of any other type of foam dispensing unit such as a unit for a squeeze foamer to make a foam dispensing unit of the present invention.

FIGS. 10(*a*) and 10(*b*) are cross-sectional views illustrating a squeeze foamer 80 that is another embodiment of the foam dispenser. In the squeeze foamer 80, a foam dispensing unit 70 according to another preferred embodiment of the present invention is attached to a neck portion 82 of a dispenser body 81. In the squeeze foamer 80 shown in FIGS. 10(*a*) and 10(*b*), the foam dispensing unit 70 is a unit for a so-called squeeze foamer, and, as in a conventional squeeze foamer, the foam dispensing unit 70 is mounted on the neck portion 82 of the dispenser body 81 of the squeeze foamer 80 and has a function of dispensing the content liquid in the form of a foam by mixing the content liquid with air to foam the content liquid. Specifically, in the squeeze foamer 80 shown in FIGS. 10(*a*) and 10(*b*), the dispenser body 81 is flexible and capable of elastic deformation through the application of a pressing force on a body 81*a* being held in hand. By pressing (squeezing) the body 81*a* held in hand (see FIG. 10(*b*)), the content liquid contained in the dispenser body 81 can be pumped out to a mixing chamber 73 provided as a confluence space inside the foam dispensing unit 70 via a tube member 83 and a liquid flow channel 71, and at the same time, the air in a head space portion inside the dispenser body 81 can be pumped out to the mixing chamber 73 via an air flow channel 72. The content liquid transferred to the mixing chamber 73 and mixed with air can be foamed in a foaming flow channel 75 extending from the mixing chamber 73 to a dispensing outlet 74 and then dispensed.

In the foam dispensing unit 70 according to another embodiment shown in FIGS. 10(*a*) and 10(*b*), a mechanism for variably positioning a passage surface, 78 is provided in the foaming flow channel 75 on the downstream side of the mixing chamber 73. As in the foam dispensing unit 10 described in the embodiment described hereinbefore, the mechanism for variably positioning a passage surface, 78 includes, for example, a loosely holding region 77 and a porous member 76, the loosely holding region 77 movably holding the porous member 76, and the porous member 76 being loosely mounted in the loosely holding region 77. The porous member 76 preferably has a spherical shape, and is preferably configured to freely rotate inside the loosely holding region 77 due to the action of a stream of content liquid passing through the loosely holding region 77 so as to variably position a content liquid passage surface of the porous member 76 such that an upstream passage surface in the pass-through direction is replaced by a downstream passage surface in the pass-through direction. With this configuration, it is possible with the foam dispensing unit 70 according to another embodiment, as with the foam dispensing unit 10 according to the embodiment described hereinbefore, to stably and smoothly repeat the operation of dispensing the content liquid over a long period of time while preventing the occurrence of clogging in the porous member 76 provided in the foaming flow channel 75.

It is not necessary for the mechanism for variably positioning a passage surface to include a loosely holding region formed in the foaming flow channel for movably holding a porous member, and a porous member loosely mounted in the loosely holding region. For example, as shown in FIGS. 11(*a*) and 11(*b*), the mechanism for variably positioning a passage surface may include a rotation axis 60 provided in the foaming flow channel and a porous member 61 rotatably attached to the rotation axis 60, and the porous member 61 may be configured to variably position a content liquid passage surface of the porous member 61 preferably such that an upstream passage surface in the pass-through direction is replaced by a downstream passage surface in the pass-through direction as a result of rotating about the vertical rotation axis 60 in the right and left directions (see FIG. 11(*a*)) or rotating about the horizontal rotation axis 60 in the up and down directions (see FIG. 11(*b*)) preferably due to the action of a stream of content liquid passing through the foaming flow channel.

Furthermore, the porous member constituting the mechanism for variably positioning a passage surface may be configured to, instead of rotating due to the action of a stream passing through the foaming flow channel, for example, move and rotate when the foam dispensing unit is attached to and detached from the dispenser body in order to refill the dispenser body with a content liquid, when the pushed pump head portion returns to its original state, or when the foam dispenser is carried, so as to move the content liquid passage surface of the porous member preferably such that the upstream passage surface in the pass-through direction is replaced by the downstream passage surface in the pass-through direction. The porous member is not necessarily rotated by 180° to be completely inverted when moving the content liquid passage surface of the porous member preferably such that the upstream passage surface in the pass-through direction is replaced by the downstream passage surface in the pass-through direction.

With respect to the embodiments described above, the present invention further discloses the following foam dispensing unit.

<1>

A foam dispensing unit that dispenses a content liquid in a foamed state by causing the content liquid pumped out via a liquid flow channel to pass through a porous member provided in a foaming flow channel together with air, the foam dispensing unit including a mechanism for variably positioning a passage surface, the mechanism rotatably holding the porous member in the foaming flow channel to variably position a content liquid passage surface of the porous member.

<2>

The foam dispensing unit as set forth in <1> above, wherein preferably, the mechanism for variably positioning a passage surface includes: a loosely holding region that is formed in the foaming flow channel and movably holds the porous member; and the porous member loosely mounted in the loosely holding region, and the porous member rotates inside the loosely holding region to variably position the content liquid passage surface.

<3>

The foam dispensing unit as set forth in <2> above, wherein preferably, the porous member has a spherical shape, and freely rotates inside the loosely holding region.

<4>

The foam dispensing unit as set forth in <2> above, wherein preferably, the porous member has a columnar or cylindrical shape, and circumferentially rotates inside the loosely holding region.

<5>

The foam dispensing unit as set forth in <1> above, wherein preferably, the mechanism for variably positioning a passage surface includes: a rotation axis provided in the foaming flow channel; and the porous member rotatably attached to the rotation axis, and the porous member rotates about the rotation axis to variably position the content liquid passage surface.

<6>

The foam dispensing unit as set forth in any one of <1> to <5> above, wherein the porous member preferably rotates due to an action of a stream passing through the foaming flow channel.

<7>

The foam dispensing unit as set forth in any one of <1> to <6> above, wherein preferably, the foam dispensing unit is mounted on a neck portion of a dispenser body via a cap portion, and includes a pump head portion provided so as to be capable of reciprocal movement with respect to the cap portion, and the foam dispensing unit is configured to, in response to a press of the pump head portion, pump out the content liquid and air from a liquid chamber and an air chamber to a mixing chamber via the liquid flow channel and an air flow channel respectively at the same time, foam the content liquid transferred to the mixing chamber in the foaming flow channel extending from the mixing chamber to a dispensing outlet, and dispense the foamed content liquid.

<8>

The foam dispensing unit as set forth in any one of <1> to <6> above, wherein preferably, the foam dispensing unit is preferably mounted on a neck portion of a dispenser body, the dispenser body is flexible and capable of elastic deformation by application of a pressing force on a body being held in hand, by pressing the body held in hand, the content liquid contained in the dispenser body is pumped out to a mixing chamber via the liquid flow channel, and at the same time, air in a head space portion inside the dispenser body is pumped out to the mixing chamber via an air flow channel, and the content liquid mixed with the air is foamed in the foaming flow channel extending from the mixing chamber to a dispensing outlet and then dispensed.

<9>

The foam dispensing unit as set forth in any one of <2> to <8> above, wherein preferably, the foaming flow channel includes a top inwardly hooked valve seat portion and a cylindrical holder, the cylindrical holder includes a reduced diameter projecting portion that projects inward from an upper inner surface of the cylindrical holder, the reduced diameter projecting portion is provided to project inward from an inner surface of the cylindrical holder such that an inner diameter thereof is smaller than an outer diameter of the porous member, and the loosely holding region is formed in a portion between the top inwardly hooked valve seat portion and the reduced diameter projecting portion of the cylindrical holder.

<10>

The foam dispensing unit as set forth in any one of <1> to <9> above, wherein the porous member is a hollow spherical porous member or a solid spherical porous member.

<11>

The foam dispensing unit as set forth in any one of <1> to <9> above, wherein the porous member is a meshed material; a molded mesh including an outer circumferential frame and a mesh plate; a hollow spherical porous member; a foam member; or a member obtained by molding a sintered metal, a perforated metal, a filter or a net into a spherical or cylindrical shape.

INDUSTRIAL APPLICABILITY

With the foam dispensing unit according to the present invention, clogging is unlikely to occur in the porous member provided in the foaming flow channel, and even if clogging occurs, the clogging can be removed, and thus it is possible to stably and smoothly repeat an operation of dispensing the content liquid over a long period of time.

The invention claimed is:

1. A foam dispensing unit, comprising:

a mechanism configured to variably position a passage surface, wherein the mechanism comprises:

a loosely holding region that is formed in a foaming flow channel, and a porous member loosely mounted in the loosely holding region which is configured to movably hold the porous member, wherein:

the porous member has a hollow spherical shape or a cylindrical shape, the porous member is configured to rotate inside the loosely holding region thereby variably positioning a content liquid passage surface of the porous member, the mechanism is configured to rotatably hold the porous member in the foaming flow channel to variably position a content liquid passage surface of the porous member, the foam dispensing unit is configured to dispense a content liquid in a foamed state by causing the content liquid pumped out via a liquid flow channel to pass through the porous member provided in the foaming flow channel together with air, the mechanism includes a cylindrical holder that forms the loosely holding region, the cylindrical holder including a reduced diameter projecting portion that projects inward from an inner surface of the cylindrical holder, and the reduced diameter projecting portion defines a curved concave surface that faces the loosely holding region and the porous member in the loosely holding region.

2. The foam dispensing unit according to claim 1, wherein the porous member has a spherical shape, and the porous member is configured to freely rotate inside the loosely holding region.

3. The foam dispensing unit according to claim 1, wherein the porous member has a cylindrical shape, and the porous member is configured to circumferentially rotate inside the loosely holding region.

4. A foam dispensing unit, comprising:

a mechanism configured to variably position a passage surface, wherein the mechanism comprises:

a porous member configured to rotate in a foaming flow channel about a horizontal rotation axis, wherein:

the porous member is configured to rotate about the horizontal rotation axis to variably position a content liquid passage surface of the porous member, the mechanism is configured to rotatably hold the porous member in the foaming flow channel to variably position the content liquid passage surface of the porous member, the foam dispensing unit is configured to dispense a content liquid in a foamed state by causing the content liquid pumped out via a liquid flow channel to pass through the porous member provided in the foaming flow channel together with air, and the porous member rotates about the horizontal rotation axis thereof when moving in up and down directions, the horizontal rotation axis remaining at all times perpendicular to a flow direction of the foaming flow channel.

5. The foam dispensing unit according to claim 1, wherein the porous member is configured to rotate due to an action of a stream passing through the foaming flow channel.

6. The foam dispensing unit according to claim 1, wherein:

the foam dispensing unit is mounted on a neck portion of a dispenser body via a cap portion, the foam dispensing unit comprises a pump head portion provided so as to be capable of reciprocal movement with respect to the cap portion, and the foam dispensing unit is configured to, in response to a press of the pump head portion, pump out the content liquid and air from a liquid chamber and an air chamber to a mixing chamber via the liquid flow channel and an air flow channel respectively at the same time, foam the content liquid transferred to the mixing chamber in the foaming flow channel extending from the mixing chamber to a dispensing outlet thereby forming a foamed content liquid, and dispense the foamed content liquid.

7. The foam dispensing unit according to claim 4, wherein the porous member is configured to rotate due to an action of a stream passing through the foaming flow channel.

8. The foam dispensing unit according to claim 4, wherein:

the foam dispensing unit is mounted on a neck portion of a dispenser body via a cap portion, the foam dispensing unit comprises a pump head portion provided so as to be capable of reciprocal movement with respect to the cap portion, and the foam dispensing unit is configured to, in response to a press of the pump head portion, pump out the content liquid and air from a liquid chamber and an air chamber to a mixing chamber via the liquid flow channel and an air flow channel respectively at the same time, foam the content liquid transferred to the mixing chamber in the foaming flow channel extending from the mixing chamber to a dispensing outlet thereby forming a foamed content liquid, and dispense the foamed content liquid.

9. The foam dispensing unit according to claim 5, wherein:

the foam dispensing unit is mounted on a neck portion of a dispenser body via a cap portion, the foam dispensing unit comprises a pump head portion provided so as to be capable of reciprocal movement with respect to the cap portion, and the foam dispensing unit is configured to, in response to a press of the pump head portion, pump out the content liquid and air from a liquid chamber and an air chamber to a mixing chamber via the liquid flow channel and an air flow channel respectively at the same time, foam the content liquid transferred to the mixing chamber in the foaming flow channel extending from the mixing chamber to a dispensing outlet thereby forming a foamed content liquid, and dispense the foamed content liquid.

10. The foam dispensing unit according to claim 7, wherein:

the foam dispensing unit is mounted on a neck portion of a dispenser body via a cap portion, the foam dispensing unit comprises a pump head portion provided so as to be capable of reciprocal movement with respect to the cap portion, and the foam dispensing unit is configured to, in response to a press of the pump head portion, pump out the content liquid and air from a liquid chamber and an air chamber to a mixing chamber via the liquid flow channel and an air flow channel respectively at the same time, foam the content liquid transferred to the mixing chamber in the foaming flow channel extending from the mixing chamber to a dispensing outlet thereby forming a foamed content liquid, and dispense the foamed content liquid.

11. The foam dispensing unit according to claim 1, wherein the porous member has the cylindrical shape.

12. The foam dispensing unit according to claim 11, wherein the porous member in the cylindrical shape is oriented in the loosely holding region such that a horizontal rotation axis of the porous member, which is a central longitudinal axis thereof, is perpendicular to the foaming flow channel at all times.

13. The foam dispensing unit according to claim 1, wherein the porous member is provided in the loosely holding region so as to rotate when the foam dispensing unit is attached to and/or detached from a dispenser body.

* * * * *